US012799948B2

(12) United States Patent
Park et al.

(10) Patent No.: US 12,799,948 B2
(45) Date of Patent: Nov. 17, 2026

(54) HUB HOUSING

(71) Applicant: Hanon Systems, Daejeon (KR)

(72) Inventors: Cheol Un Park, Daejeon (KR); Dal Hyun Ahn, Daejeon (KR); Moon-Seok Choi, Daejeon (KR); Young Woo Choi, Daejeon (KR); Jun Ho Kim, Daejeon (KR); Jun Woo Jo, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 19/063,177

(22) Filed: Feb. 25, 2025

(65) Prior Publication Data

US 2026/0251153 A1 Aug. 27, 2026

(51) Int. Cl.
*F04D 29/32* (2006.01)
*F04D 25/08* (2006.01)

(52) U.S. Cl.
CPC ..... *F04D 29/329* (2013.01); *F04D 25/08* (2013.01)

(58) Field of Classification Search
CPC ..... F04D 25/08; F04D 29/329; F04D 29/661; F04D 29/668; F04D 29/70
See application file for complete search history.

(56) References Cited

U.S. PATENT DOCUMENTS

| | | | | |
|---|---|---|---|---|
| 5,944,497 | A * | 8/1999 | Kershaw | F04D 29/5806 417/368 |
| 7,455,502 | B2 * | 11/2008 | Spaggiari | F04D 25/082 416/93 R |
| 10,451,077 | B2 * | 10/2019 | Maier | F04D 29/329 |
| 11,041,498 | B2 * | 6/2021 | Okuda | F04D 25/082 |
| 12,313,080 | B2 * | 5/2025 | Dai | F04D 25/08 |
| 2016/0186771 | A1 * | 6/2016 | Evers | F04D 17/16 416/90 R |
| 2018/0306208 | A1 * | 10/2018 | Gabbin | F04D 29/646 |
| 2025/0084866 | A1 * | 3/2025 | Dai | F04D 25/08 |

FOREIGN PATENT DOCUMENTS

| | | | |
|---|---|---|---|
| CN | 119664724 A | * | 3/2025 |
| KR | 101985342 | | 6/2019 |
| KR | 20240059674 A | * | 5/2024 |

* cited by examiner

*Primary Examiner* — Brian P Wolcott
(74) *Attorney, Agent, or Firm* — NORTON ROSE FULBRIGHT US LLP

(57) ABSTRACT

The present invention relates to a hub housing applied to a driving motor of a cooling fan. According to the hub housing of the present invention according to the above configuration, the open structure such as a hole may be formed in the side surface of the hub housing to discharge foreign substances introduced therein, thereby preventing the foreign substances from accumulating in the hub and solving a fan unbalance problem due to the accumulation of the foreign substances, and since a separate sealing material (sponge or the like) for blocking the path along which foreign substances such as sand and dust flows into the inner space of the hub is not required, it is possible to reduce manufacturing costs.

9 Claims, 7 Drawing Sheets

HUB HOUSING

BACKGROUND OF THE INVENTION

Field of the Invention

The present invention relates to a hub housing applied to a driving motor of a cooling fan.

Description of the Related Art

In general, a vehicle is provided with a cooling means capable of preventing overheating of an engine, an air conditioning means having an air conditioning function for passenger spaces inside the vehicle. As the cooling means and the air conditioning means, a radiator for cooling the engine and a condenser for cooling air conditioner refrigerant are configured, and a fan shroud is installed on one surfaces thereof to improve heat exchange efficiency of the radiator and the condenser.

Here, among the cooling fans for a vehicle, there are a condenser fan for cooling refrigerant of an air conditioner and a radiator fan for cooling coolant of the engine, and the cooling fans are each rotated by the driving of a corresponding fan motor.

In this case, the cooling fans include a hub that serves as the center, and a plurality of blades are formed radially on the hub. Accordingly, kinetic energy may be transferred to air by the blades so that a pressure and flow volume are changed by the kinetic energy, and the air obtained from this energy may cool the engine at a rear end of the cooling fan.

However, in the case of the related art, a side surface of the hub is formed in a shape perpendicular to a floor surface according to the shape of a driving motor, and thus foreign substances introduced during rotation of the fan are easily deposited inside the hub. In this way, the foreign substances deposited inside the hub of the fan can affect the balance of the blades during the operation of the cooling fan and can be the cause of increased vibration noise.

Document of Related Art (Patent Document 1) Korean Patent Registration No. 10-1985342 tilted "cooling fan for a vehicle" dated on May 28, 2019

SUMMARY OF THE INVENTION

The present invention has been made in efforts to solve the above problems and is directed to providing a hub housing in which an open structure such as a hole may be formed in a side surface of the hub housing to discharge foreign substances introduced therein, thereby preventing the foreign substances from accumulating in a hub and solving a fan unbalance problem due to the accumulation of the foreign substances, and since a separate sealing material (sponge or the like) for blocking a path along which foreign substances such as sand and dust flows into an inner space of the hub is not required, it is possible to reduce manufacturing costs.

To solve the above problems, a hub housing according to one embodiment of the present invention includes a hub housing coupled to a driving shaft of a driving motor to surround the driving motor and to which a blade formed to extend radially is connected, which includes a central portion inserted onto the driving shaft and formed flat in a direction perpendicular to the driving shaft, an extension having one end formed integrally with the central portion, formed to extend from the central portion, and formed to surround and support a side surface of the driving motor, and a rib formed to protrude from an inner side of a portion in which the blade and the extension are coupled, wherein the extension includes at least one foreign substance discharge hole part.

In addition, the foreign substance discharge hole part includes a first hole formed to pass through the hub housing at a position at which the rib comes into contact with one edge thereof.

In addition, the first hole is formed to extend in an extension direction of the extension and is formed in a shape in which one end adjacent to one end of the extension is closed and the other end adjacent to the other end of the extension is open.

In addition, one edge of the first hole comes into contact with an edge in a direction opposite to a rotational direction of the driving motor among edges of the rib.

In addition, the first hole is formed to extend in an extension direction of the extension and formed in a shape in which both ends of the first hole are closed.

In addition, the foreign substance discharge hole part further includes a second hole formed to pass through the hub housing at a position spaced a predetermined distance from the rib.

In addition, the hub housing further includes a ventilation hole formed to pass through the hub housing at an edge at which the central portion and the extension are connected.

In addition, the ventilation hole is formed at a position spaced a predetermined distance from a position corresponding to the first hole in the rotational direction of the driving motor.

In addition, the foreign substance discharge hole part is formed to pass through the hub housing at a position at which the rib formed to protrude from the inner side of the portion in which the blade and the extension are coupled comes into contact with one edge thereof, and includes a third hole and a fourth hole that are formed to be spaced a predetermined distance from each other in an extension direction of the extension.

In addition, the third hole is formed in a shape in which one adjacent to one end of the extension and the other end adjacent to the fourth hole are both closed, and the fourth hole is formed in a shape in which one end adjacent to the third hole is closed and the other end adjacent to the other end of the extension is open.

DETAILED DESCRIPTION OF THE INVENTION

Hereinafter, the technical spirit of the present invention will be described in more detail with reference to the accompanying drawings. Prior to this, terms or words used in this specification and claims should not be interpreted as limited to their usual or dictionary meanings and should be interpreted as meanings and concepts that conform to the technical idea of the present invention based on the principle that the inventor can appropriately define the concepts of the terms in order to describe his or her own invention in the best way.

Hereinafter, a hub housing 1000 of the present invention and a first embodiment of the hub housing 1000 will be described with reference to FIGS. 1 to 3.

Figure 1:
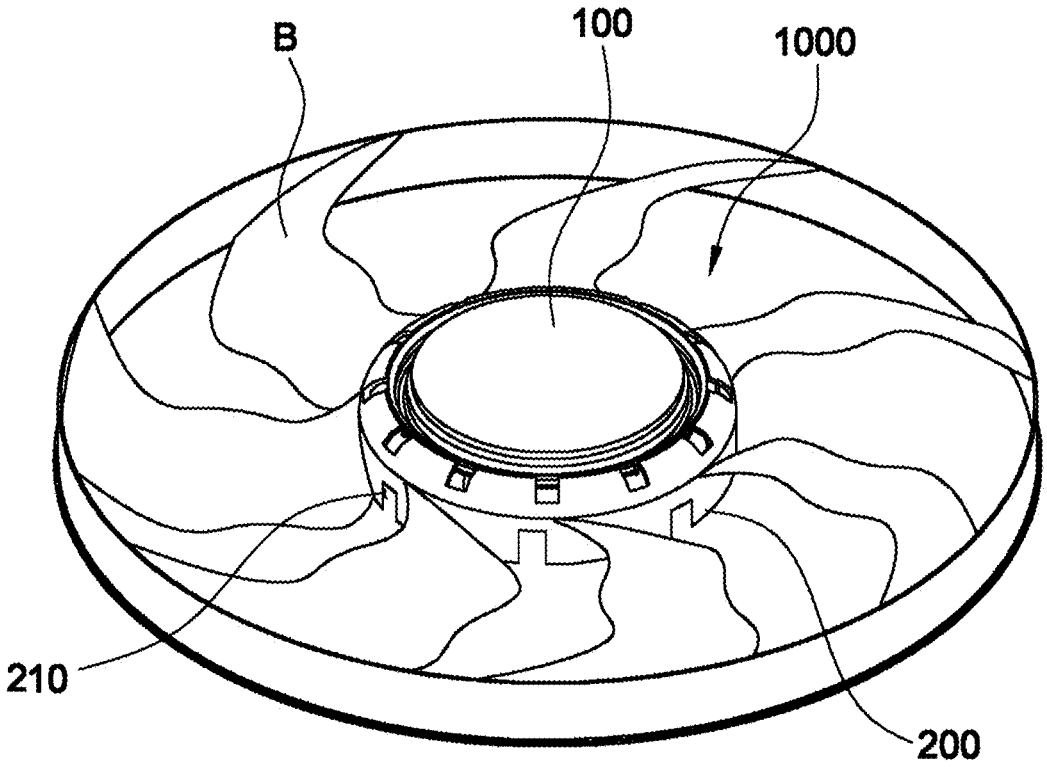
FIG. 1 is a perspective view illustrating a hub housing of the present invention.

As illustrated in FIG. 1, the hub housing 1000 of the present invention is coupled to a driving shaft of a driving motor to surround the driving motor and has a blade B formed to extend radially connected thereto and may include a central portion 100, an extension 200, and a rib 300. More specifically, the central portion 100 may be formed so that the driving shaft may be inserted and formed flat in a direction perpendicular to the driving shaft. In addition, the extension 200 may have one end formed integrally with the central portion 100 and may be formed to extend from the central portion 100. Accordingly, the extension 200 may surround and support a side surface of the driving motor. In addition, the hub housing 1000 of the present invention may include the rib 300. The rib 300 may be formed to protrude from an inner side of a portion in which the blade B and the extension 200 are coupled.

In this case, the extension 200 may include at least one foreign substance discharge hole part 210. By including the foreign substance discharge hole part 210, fine foreign substances flowing into the hub housing 1000 of the present invention may be discharged through the foreign substance discharge hole part 210, thereby preventing the foreign substances from accumulating inside the hub and improving a fan unbalance problem (which is a structure in which foreign substances are easily accumulated because air flows into the hub during the operation of the fan).

Figure 2:
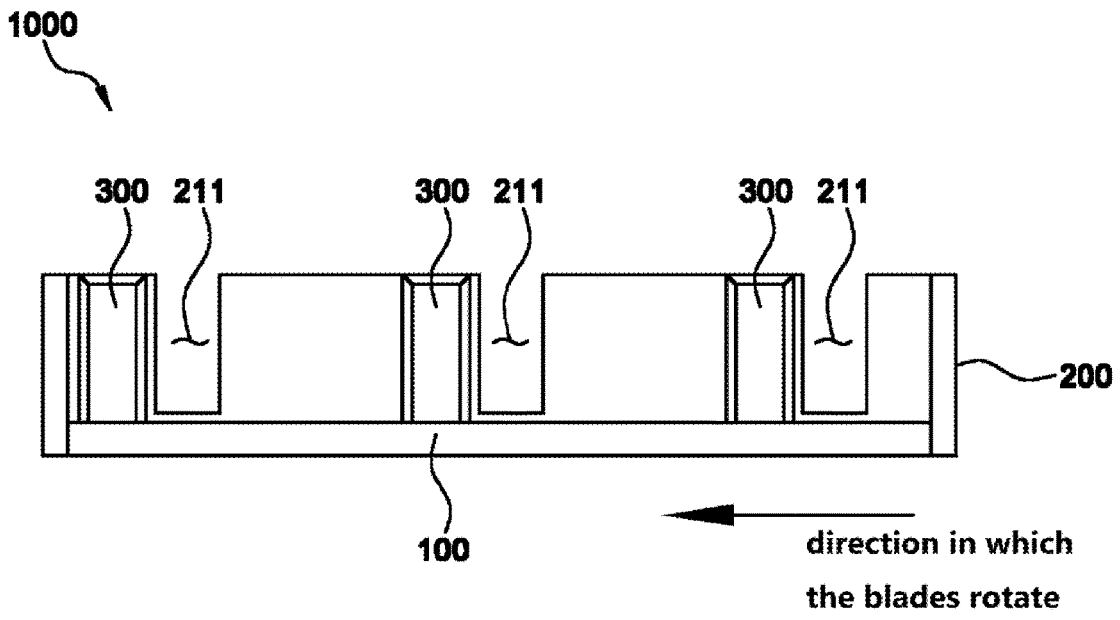
FIG. 2 is a cross-sectional view illustrating a first embodiment of the hub housing of the present invention.

In this case, as illustrated in FIG. 2, the foreign substance discharge hole part 210 may include a first hole 211 formed to pass through the hub housing 1000 at a position at which the rib 300 comes into contact with one edge thereof. In this case, the first hole 211 may be formed to extend in an extension direction of the extension 200 and formed in a shape in which one end adjacent to one end of the extension 200 is closed and the other end adjacent to the other end of the extension 200 is open. Accordingly, the foreign substances inside the hub housing 1000 may be discharged more smoothly to the open side of the first hole 211.

More specifically, the first hole 211 may be formed at an opposite side in a direction in which the driving motor rotates based on the rib 300. The first hole 211 may be formed to come into contact with the rib 300 to guide the foreign substances rotating in a rotational direction of the driving motor inside the hub housing 1000 to be naturally discharged to the outside of the hub housing 1000 through the first hole 211 after colliding with the rib 300. That is, it is possible to maximize discharge efficiency of the foreign substances.

Figure 3:
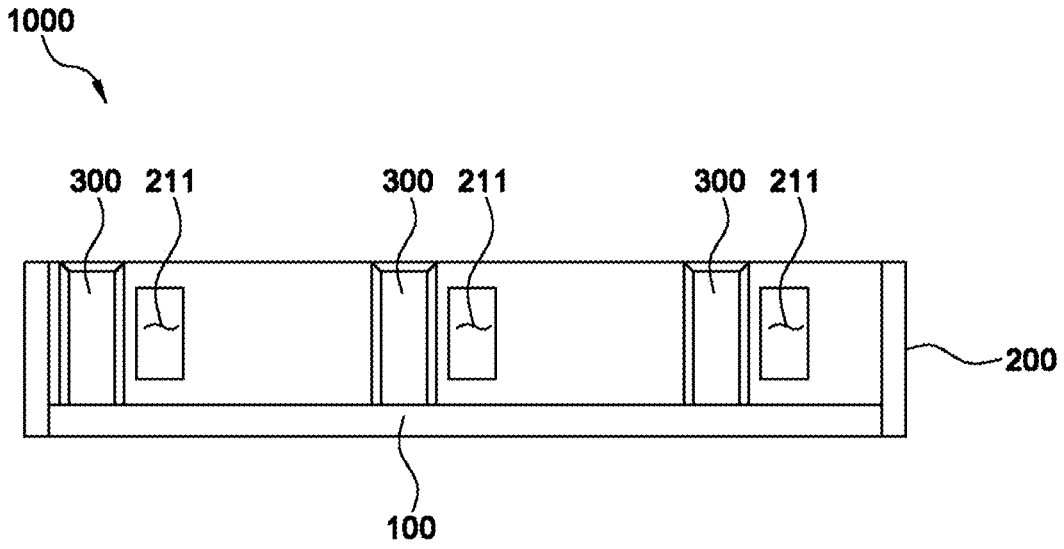
FIG. 3 is a cross-sectional view illustrating a specific embodiment of the first embodiment of the hub housing of the present invention.

Furthermore, in a specific embodiment of the first embodiment of the hub housing 1000 illustrated in FIG. 3, the first hole 211 may be formed to extend in the extension direction of the extension 200, and both ends of the first hole 211 may be formed in a closed shape. Accordingly, even when a rotation speed of the driving motor is high and a hydraulic pressure applied to the first hole 211 is high, stress can be less concentrated at an edge of the first hole 211, and the structure of the extension 200 can be maintained more stably.

Hereinafter, a second embodiment of the hub housing 1000 of the present invention will be described with reference to FIG. 4.

Figure 4:
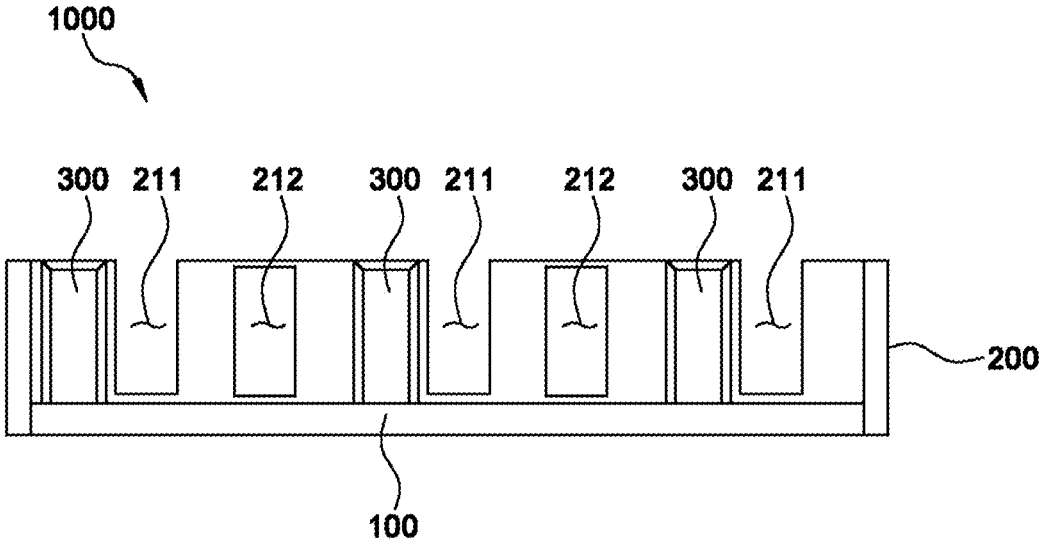
FIG. 4 is a cross-sectional view illustrating a second embodiment of the hub housing of the present invention.

As illustrated in FIG. 4, in the second embodiment of the hub housing 1000, the foreign substance discharge hole part 210 may further include a second hole 212 formed to pass through the hub housing 1000 at a position spaced a predetermined distance from the rib 300. In this case, the foreign substance discharge hole part 210 may also include the first hole 211 of the first embodiment. That is, a spacing distance between the second hole 212 and the rib 300 may be longer than a width of the first hole 211. In this case, the second hole 212 may be formed to extend in the extension direction of the extension 200, and one end adjacent to one end of the extension 200 may be closed. In addition, the other end adjacent to the other end of the extension 200 may be formed in a shape that is opened or closed according to the material of the hub housing 1000 and the rotation speed of the driving motor.

By applying the second embodiment of the hub housing 1000, the foreign substance discharge hole part 210 may allow foreign substances with larger particles, that is, foreign substances that bounces a longer distance when colliding with the rib 300, to be easily discharged to the outside through the second hole 212.

Hereinafter, a third embodiment of the hub housing 1000 of the present invention will be described with reference to FIGS. 5 and 6.

Figure 5:
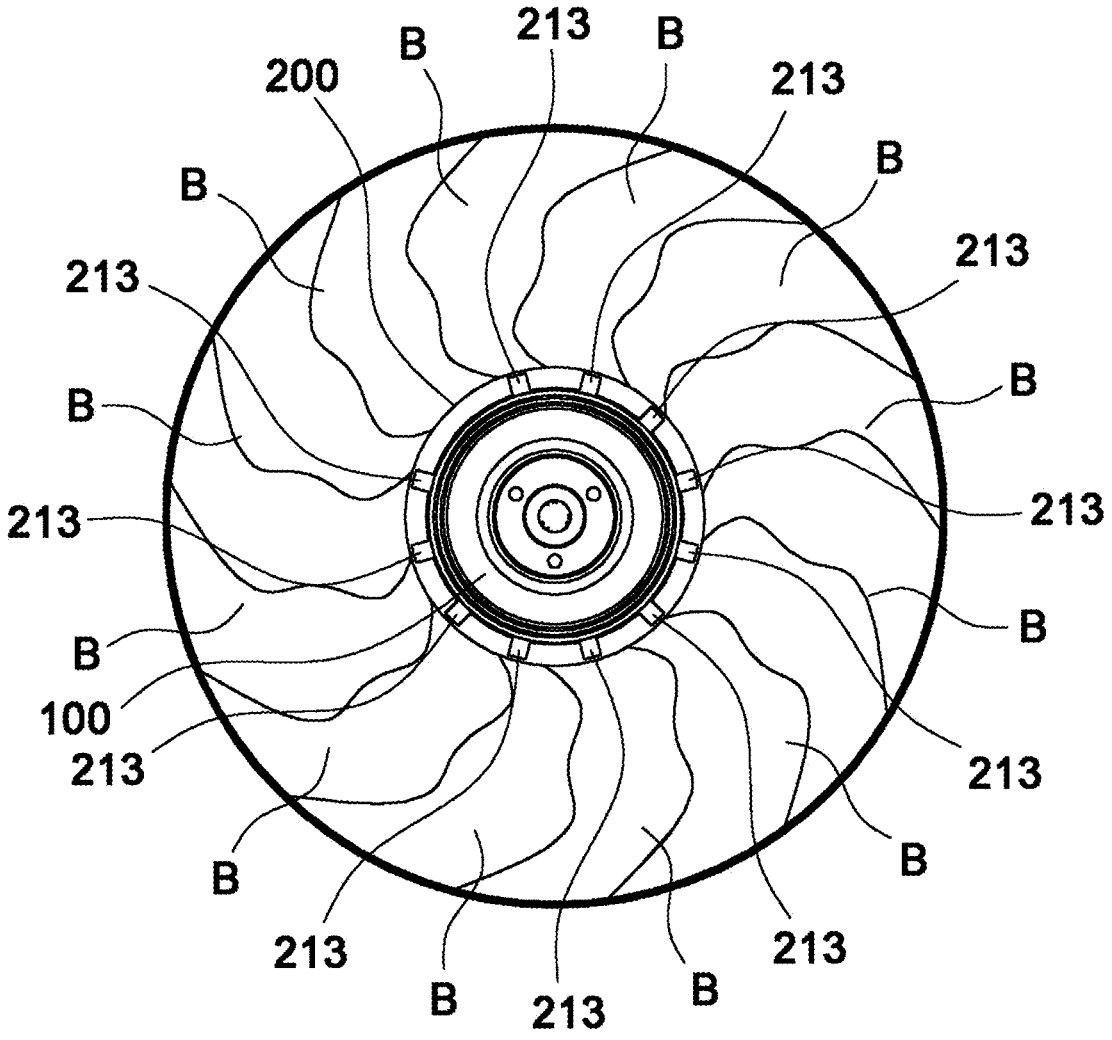
FIG. 5 is a top view illustrating a third embodiment of the hub housing of the present invention.

As illustrated in FIG. 5, in the third embodiment of the hub housing 1000, the hub housing 1000 may include a ventilation hole 400 formed to pass therethrough at an edge to which the central portion 100 and the extension 200 are connected. The ventilation holes 400 may be formed to be spaced the same distance from each other. Accordingly, air may be communicated between the inside and outside of the hub housing 1000 through the ventilation holes 400, and an internal motor can be uniformly cooled as third holes 213 are uniformly formed.

Figure 6:
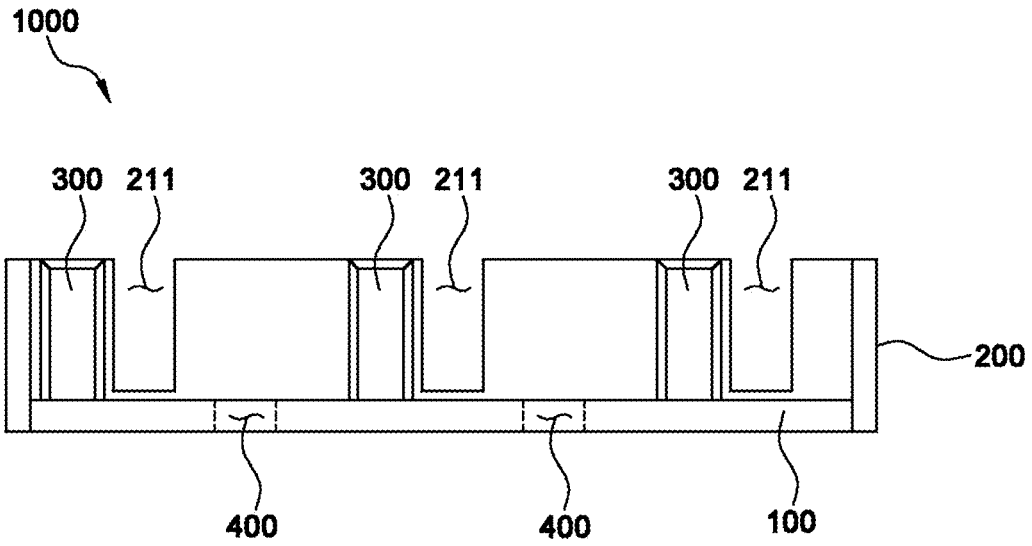
FIG. 6 is a cross-sectional view illustrating the third embodiment of the hub housing of the present invention.

In addition, the ventilation holes 400 may be formed along with the first hole 211 of the first embodiment and, as illustrated in FIG. 6, the ventilation hole 400 may be formed at a position spaced a predetermined distance from a position corresponding to the first hole 211 in the rotational direction of the driving motor. That is, a width of one end of the ventilation hole 400 may be narrower than a width of one end of the first hole 211 (in this case, the widths of the first hole 211 and the ventilation hole 400=horizontal lengths in FIG. 6), and the one end of the ventilation hole 400 may be formed to face the one end of the first hole 211. Accordingly, even when foreign substances are introduced through the ventilation holes 400, the foreign substances can be easily discharged through the first holes 211.

Hereinafter, a fourth embodiment of the hub housing 1000 of the present invention will be described with reference to FIG. 7.

Figure 7:
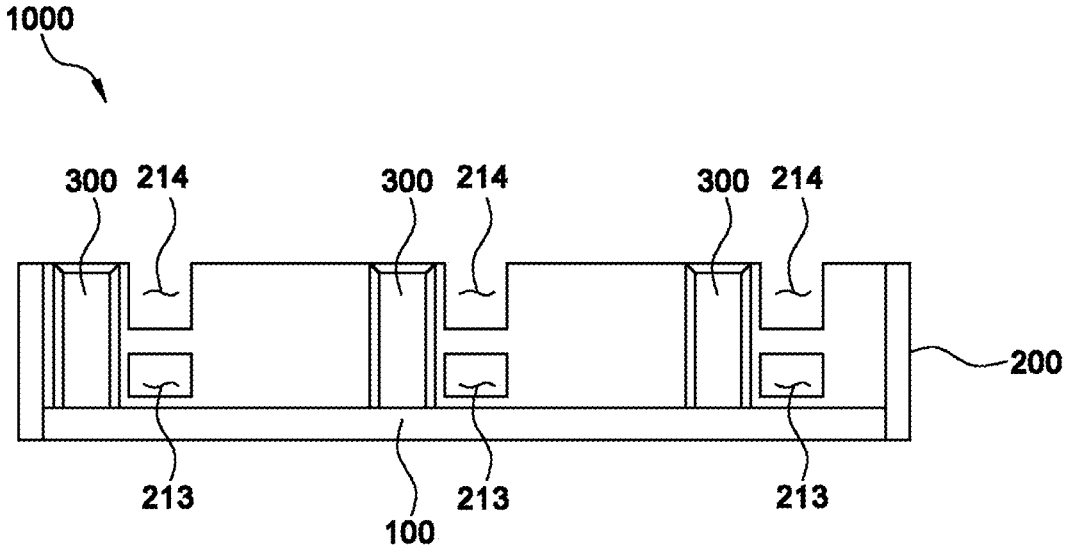
FIG. 7 is a cross-sectional view illustrating a fourth embodiment of the hub housing of the present invention.

As illustrated in FIG. 7, in the fourth embodiment of the hub housing 1000, the foreign substance discharge hole part 210 may be formed to pass through the hub housing 1000 at a position at which the rib 300 formed to protrude from an inner side of a portion to which the blade B and the extension 200 are coupled comes into contact with one edge thereof and may include a third hole 213 and a fourth hole 214 that are formed to be spaced a predetermined distance from each other in the extension direction of the extension 200. In this case, the third hole 213 and the fourth hole 214 may be formed at opposite sides in the rotational direction of the driving motor based on the rib 300. In addition, it is preferable that the third hole 213 is formed in a shape in which one end adjacent to one end of the extension 200 and the other end adjacent to the fourth hole 214 are both closed, and the fourth hole 214 is formed in a shape in which one end adjacent to the third hole 213 is closed and the other end adjacent to the other end of the extension 200 is open.

More specifically, a length of the third hole 213 may be shorter than a length of the fourth hole 214 (in this case, the lengths of the third hole 213 and the fourth hole 214=vertical lengths in FIG. 7), and the third hole 213 and the fourth hole 214 may be formed to be spaced a sufficient distance from each other. The third hole 213 and the fourth hole 214 may be formed at the other end of the extension 200 to discharge the foreign substances inside the hub housing 1000 to the outside.

The third hole 213 and the fourth hole 214 may be formed to come into contact with the rib 300 to guide the foreign substances rotating inside the hub housing 1000 in the rotational direction of the driving motor to be naturally discharged to the outside of the hub housing 1000 through the third hole 213 and the fourth hole 214 after colliding with the rib 300. That is, it is possible to maximize discharge efficiency of the foreign substances. Accordingly, even when the rotation speed of the driving motor is high and the hydraulic pressure applied to a surface of the extension 200 is high, stress can be less concentrated at edges of the third hole 213 and the fourth hole 214, and the structure of the extension 200 can be maintained more stably.

According to the hub housing of the present invention according to the above configuration, the open structure such as a hole may be formed in the side surface of the hub housing to discharge foreign substances introduced therein, thereby preventing the foreign substances from accumulating in the hub and solving the fan unbalance problem due to the accumulation of the foreign substances, and since a separate sealing material (sponge or the like) for blocking the path along which foreign substances such as sand and dust flows into the inner space of the hub is not required, it is possible to reduce manufacturing costs.

The technical spirit of the present invention should not be construed as limited to the above-described embodiments. Not only the scope of applications is diverse, but also various modifications may be made by those skilled in the art without departing from the gist of the present invention as claimed in the claims. Therefore, these improvements and changes fall within the scope of the present invention as long as they are obvious to those skilled in the art.

DESCRIPTION OF REFERENCE NUMERALS

1000: hub housing
100: central portion
200: extension
210: foreign substance discharge hole part
211: first hole
212: second hole
213: third hole
214: fourth hole
300: rib
400: ventilation hole
B: blade

What is claimed is:

1. A hub housing to which blades formed to extend radially is connected, the hub housing comprising:
- a central portion formed flat in a direction perpendicular to a rotational axis of the blades;
- an extension having one end formed integrally with the central portion, formed to extend from the central portion; and
- a rib formed to protrude from an inner side of a portion in which each of the blades and the extension are coupled,
- wherein the extension includes at least one foreign substance discharge hole part,
- wherein the foreign substance discharge hole part includes a first hole formed to pass through the hub housing at a position at which the rib comes into contact with one edge thereof,
- wherein the first hole is formed to extend in an extension direction of the extension, and is formed in a shape in which one end adjacent to one end of the extension is closed and the other end adjacent to the other end of the extension is open.

2. A hub housing to which blades formed to extend radially is connected, the hub housing comprising:
- a central portion formed flat in a direction perpendicular to a rotational axis of the blades;
- an extension having one end formed integrally with the central portion, formed to extend from the central portion; and
- a rib formed to protrude from an inner side of a portion in which each of the blades and the extension are coupled,
- wherein the extension includes at least one foreign substance discharge hole part,
- wherein the foreign substance discharge hole part is formed to pass through the hub housing at a position at which the rib formed to protrude from the inner side of the portion in which the blade and the extension are coupled comes into contact with one edge thereof, and
- includes a third hole and a fourth hole that are formed to be spaced a predetermined distance from each other in an extension direction of the extension,
- wherein the third hole is formed in a shape in which one end adjacent to one end of the extension and the other end adjacent to the fourth hole are both closed, and
- the fourth hole is formed in a shape in which one end adjacent to the third hole is closed and the other end adjacent to the other end of the extension is open.

3. A hub housing to which blades are formed to extend radially is connected, the hub housing comprising:
- a central portion formed flat in a direction perpendicular to a rotational axis of the blades;
- an extension having one end formed integrally with the central portion, formed to extend from the central portion; and
- a rib formed to protrude from an inner side of a portion in which each of the blades and the extension are coupled,
- wherein the extension includes at least one foreign substance discharge hole part,
- wherein the at least one foreign substance discharge hole part is formed between each of the blades, thereby generating flow during the blades rotation to discharge a foreign substance,
- wherein the at least one foreign substance discharge hole part is formed on a surface of the extension parallel to the rotational axis of the blades,
- wherein the at least one foreign substance discharge hole part is formed at an opposite side in a direction in which the blades rotates based on the rib, wherein the at least one foreign substance discharge hole part includes a first hole formed to pass through the hub housing at a position at which the rib comes into contact with one edge thereof, and wherein the first hole is formed to extend in an extension direction of the extension, and is formed in a shape in which one end adjacent to one end of the extension is closed and the other end adjacent to the other end of the extension is open.

4. The hub housing of claim 1, wherein one edge of the first hole comes into contact with an edge in a direction opposite to a rotational direction of the blades among edges of the rib.

5. The hub housing of claim 3, wherein the first hole is formed to extend in an extension direction of the extension, and is formed in a shape in which both ends of the first hole are closed.

6. The hub housing of claim 3, wherein the foreign substance discharge hole part further includes a second hole formed to pass through the hub housing at a position spaced a predetermined distance from the rib.

7. The hub housing of claim 3, further comprising a ventilation hole formed to pass through the hub housing at an edge at which the central portion and the extension are connected.

8. The hub housing of claim 7, wherein the ventilation hole is formed at a position spaced a predetermined distance from a position corresponding to the first hole in the rotational direction of the blades.

9. A hub housing to which blades are formed to extend radially is connected, the hub housing comprising:

a central portion formed flat in a direction perpendicular to a rotational axis of the blades;

an extension having one end formed integrally with the central portion, formed to extend from the central portion; and a rib formed to protrude from an inner side of a portion in which each of the blades and the extension are coupled, wherein the extension includes at least one foreign substance discharge hole part, wherein the at least one foreign substance discharge hole part is formed between each of the blades, thereby generating flow during the blades rotation to discharge a foreign substance, wherein the at least one foreign substance discharge hole part is formed on a surface of the extension parallel to the rotational axis of the blades, wherein the at least one foreign substance discharge hole part is formed at an opposite side in a direction in which the blades rotates based on the rib, wherein the foreign substance discharge hole part is formed to pass through the hub housing at a position at which the rib formed to protrude from the inner side of the portion in which each of the blades and the extension are coupled comes into contact with one edge thereof, and includes a third hole and a fourth hole that are formed to be spaced a predetermined distance from each other in an extension direction of the extension, and wherein the third hole is formed in a shape in which one end adjacent to one end of the extension and the other end adjacent to the fourth hole are both closed, and the fourth hole is formed in a shape in which one end adjacent to the third hole is closed and the other end adjacent to the other end of the extension is open.

* * * * *